US008821188B2

(12) United States Patent
Chang et al.

(10) Patent No.: US 8,821,188 B2
(45) Date of Patent: Sep. 2, 2014

(54) ELECTRICAL CONNECTOR ASSEMBLY USED FOR SHIELDING

(71) Applicants: Yen-Chih Chang, New Taipei (TW); Ke-Hao Chen, New Taipei (TW); Chun-Yi Chang, New Taipei (TW)

(72) Inventors: Yen-Chih Chang, New Taipei (TW); Ke-Hao Chen, New Taipei (TW); Chun-Yi Chang, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 10 days.

(21) Appl. No.: 13/757,737

(22) Filed: Feb. 2, 2013

(65) Prior Publication Data

US 2013/0237090 A1 Sep. 12, 2013

(30) Foreign Application Priority Data

Mar. 7, 2012 (TW) ..... 101107562
Mar. 7, 2012 (TW) ..... 101107563

(51) Int. Cl.
*H01R 13/648* (2006.01)

(52) U.S. Cl.
USPC ..... 439/607.01

(58) Field of Classification Search
USPC ..... 439/607.01, 66, 108, 83, 342, 857, 856
See application file for complete search history.

(56) References Cited

U.S. PATENT DOCUMENTS

| | | | | |
|---|---|---|---|---|
| 6,206,707 | B1 * | 3/2001 | Huang | 439/74 |
| 6,264,476 | B1 * | 7/2001 | Li et al. | 439/66 |
| 6,809,255 | B1 * | 10/2004 | Chun | 174/382 |
| 7,628,652 | B2 * | 12/2009 | Ting | 439/630 |
| 2001/0002343 | A1 * | 5/2001 | Suzuki | 439/101 |
| 2003/0124879 | A1 * | 7/2003 | Ng et al. | 439/66 |
| 2005/0233610 | A1 * | 10/2005 | Tutt et al. | 439/66 |

FOREIGN PATENT DOCUMENTS

CN 202034567 U 11/2011

* cited by examiner

*Primary Examiner* — Edwin A. Leon
(74) *Attorney, Agent, or Firm* — Wei Te Chung; Ming Chieh Chang

(57) ABSTRACT

An electrical connector includes an insulative housing has a mating surface and a mounting surface opposite to the mating surface, a plurality of receiving holes penetrated from the mating surface to the mounting surface, a plurality of terminals received in the receiving holes and a grounding route assembled on the mating surface, wherein a shielding device exposed in the receiving holes and electrically connecting with the grounding route.

18 Claims, 11 Drawing Sheets

ELECTRICAL CONNECTOR ASSEMBLY USED FOR SHIELDING

1. FIELD OF THE INVENTION

The present invention relates to an electrical connector assembly, and more particularly to an electrical connector assembly has a whole grounding net for shielding an electrical connector mounted to a printed circuit board for receiving an Integrated Circuit package.

2. DESCRIPTION OF THE PRIOR ART

As the recent technology show, a number of electrical connectors have to set a grounding device due to high transmitting speed and high frequency. The transmitting speed becomes faster and faster, the influence of the interference becomes larger and larger. The electrical connector not only includes signal contacts, but also includes grounding contacts assembled around the signal contacts, so as to prevent the interference produced by the signal contact.

An electrical connector electrically connecting a chip module to a printed circuit board is described in Chinese Patent No. 202034567, issued to WANG on Dec. 9, 2011. The electrical connector includes a socket body with a plurality of electrical contacts secured therein. The socket body also includes a shielding plate assembled in the socket body and a number of shielding plates assembled between the adjacent contacts respectively. The socket body includes a slot that having a number of receiving holes. Each of the shielding plates receives in one receiving hole. The structure of the socket body is complex and the shielding effect is bad.

Therefore, it is needed to find a new electrical socket to overcome the problems mentioned above.

SUMMARY OF THE INVENTION

Accordingly, an object of the present invention is to provide an electrical connector assembly getting better shielding result.

In order to achieve the object set forth, an electrical connector comprises an insulative housing comprises a mating surface and a mounting surface opposite to the mating surface, a plurality of receiving holes penetrated from the mating surface to the mounting surface, a plurality of terminals received in the receiving holes, a grounding route assembled on the mating surface and a shielding device exposed in the receiving holes and electrically connecting with the grounding route.

In order to achieve the object set forth, an electrical connector assembly electrically connecting a chip module to a printed circuit board, and comprises an electrical connector comprises an insulative housing with a plurality of receiving holes and a plurality of terminals received in the receiving holes, the insulative housing has a mating surface and a mounting surface opposite to the mating surface; an electrical component assembled to the electrical connector, and comprises a substrate, a plurality of pads assembled on the substrate and a plurality of grounding elements assembled on the substrate, the grounding element is closed to the pad and located around the pad; and wherein the electrical connector also comprises a grounding route assembled on the mating surface, a shielding device exposed in the receiving holes and electrically connecting with the grounding route, the grounding elements electrically connect with the grounding route.

DESCRIPTION OF PREFERRED EMBODIMENT

Figure 1:
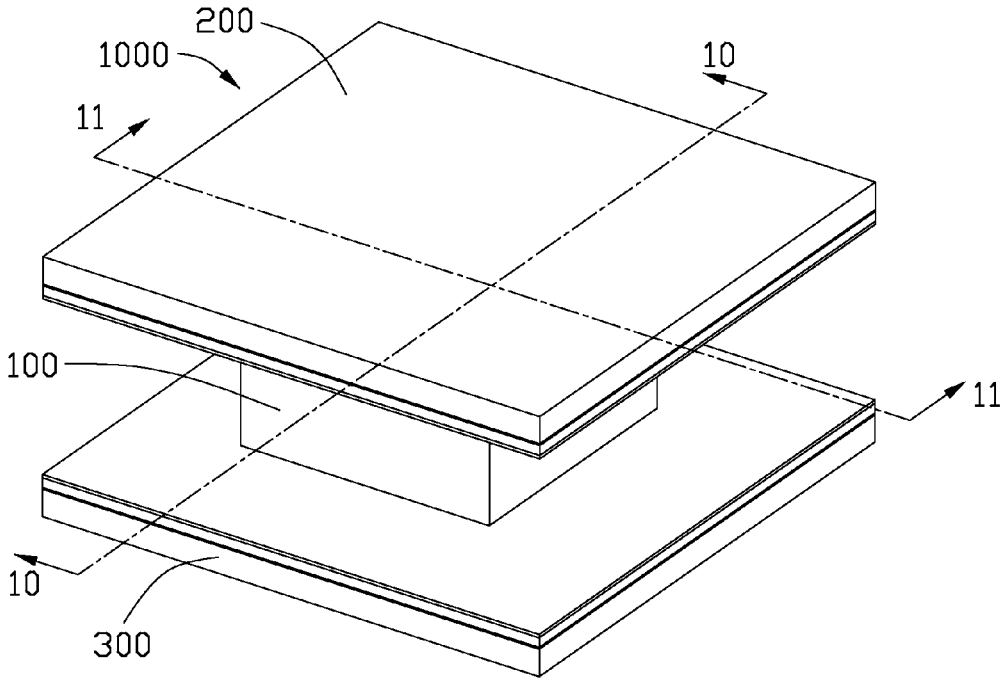
FIG. 1 is an isometric, assembled view of an electrical connector assembly in accordance with a preferred embodiment of the present invention.

Reference will now be made to the drawings to describe the present invention in detail.

Referring to FIGS. 1-11, an electrical connector assembly 1000 according to the present invention comprises an electrical connector 100, a chip module 200 and a print circuit board 300 assembled thereon. The electrical connector 100 is used to electrically connecting the chip module 200 and the print circuit board 300. The electrical connector 100 comprises an insulative housing 1, a plurality of terminals 2 received therein, a plurality of shielding plate 3 received therein and a plurality of solder balls 400 used for soldering the terminals 2 to the printed circuit board 300.

Figure 3:
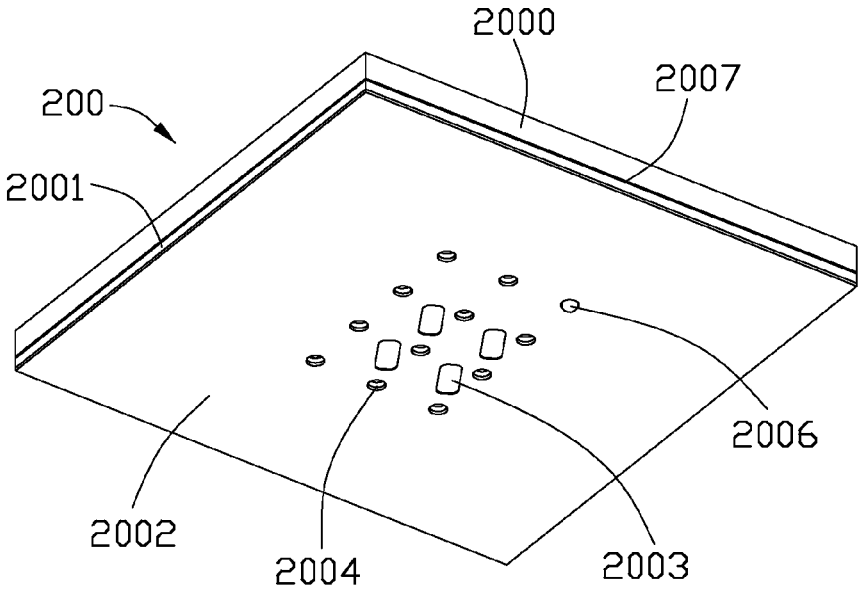
FIG. 3 is an isometric view of the chip module shown in FIG. 1.

Referring to FIG. 3, the chip module 200 locates on the electrical connector 100 and comprises an upper layer 2000, a grounding base 2007, a lower layer 2001 and an insulation layer 2002 from top to bottom direction. The bottom of the chip module 200 (includes the lower layer 2001 and the insulation layer 2002) has a plurality of pads 2003 and a plurality of grounding elements 2006 adjacent to the pads 2003. Each of the pads 2003 is surrounded by the grounding elements 2006 that are arranged in a matrix. The bottom of the chip module 200 has a plurality of slots 2004 to receive the grounding elements 2006. The grounding base 2007 and the insulation layer 2002 forms a substrate. The pads 2003 are tilted and electrically connected with the substrate.

Figure 4:
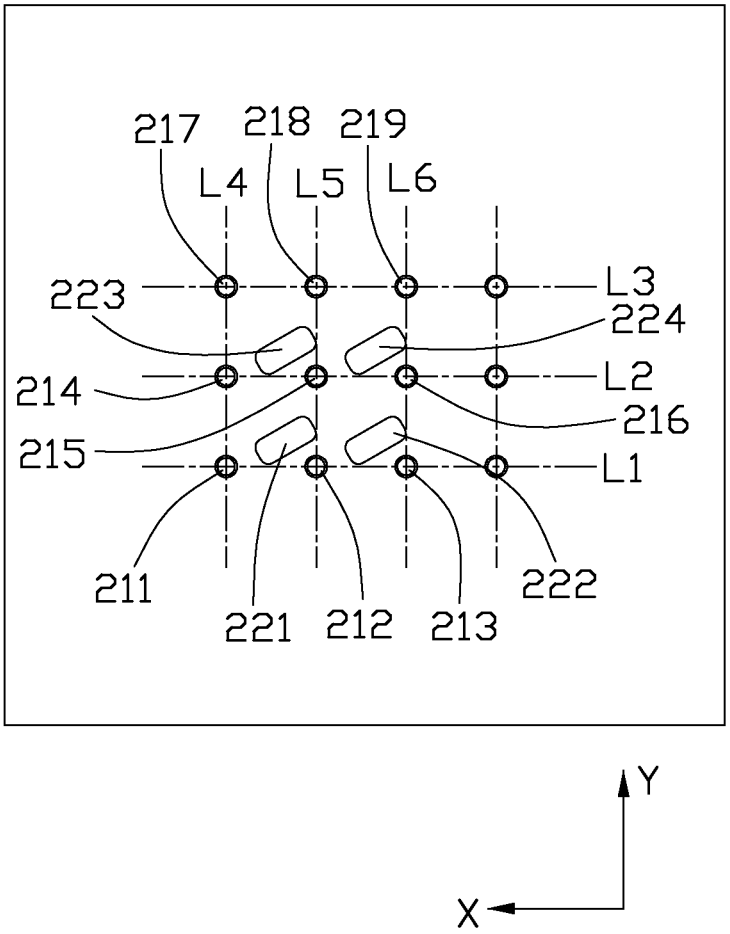
FIG. 4 is a bottom view of the chip module shown in FIG. 3.

Referring to FIGS. 3-4, the chip module 200 comprise at least four pads 2003 and at least nine grounding elements 2006, the grounding elements 2006 are arranged with a matrix and each of the pads 2003 is surrounded by four grounding elements 2006. According to the preferred embodiment of the present invention, the pads 2003 comprise a first pad 221, a second pad 222, a third pad 223 and a fourth pad 224. The grounding elements 2006 comprise a first element 211, a second element 212, a third element 213, a fourth element 214, a fifth element 215, a sixth element 216, a seventh element 217, a eighth element 218 and a ninth element 219. The first pad 221 is surrounded by the first element 211, the second element 212, the fourth element 214 and the fifth element 215. The second pad 222 is surrounded by the second element 212, a third element 213, a fifth element 215 and a sixth element 216. The third pad 223 is surrounded by the fourth element 214, the fifth element 215, the seventh element 217 and the eighth element 218. The fourth pad 224 is surrounded by the fifth element 215, the sixth element 216, the eighth element 218 and the ninth element 219.

The first element 211, the second element 212 and the third element 213 are arranged in a first line L1. The fourth element 214, the fifth element 215 and the sixth element 216 are arranged in a second line L2. The seventh element 217, the eighth element 218 and the ninth element 219 are arranged in a third line L3. The first element 211, the fourth element 214 and the seventh element 217 are arranged in a fourth line L4. The second element 212, the fifth element 215 and the eighth element 218 are arranged in a fifth line L5. The third element 213, the sixth element 216 and the ninth element 219 are arranged in a sixth element L6.

Figure 2:
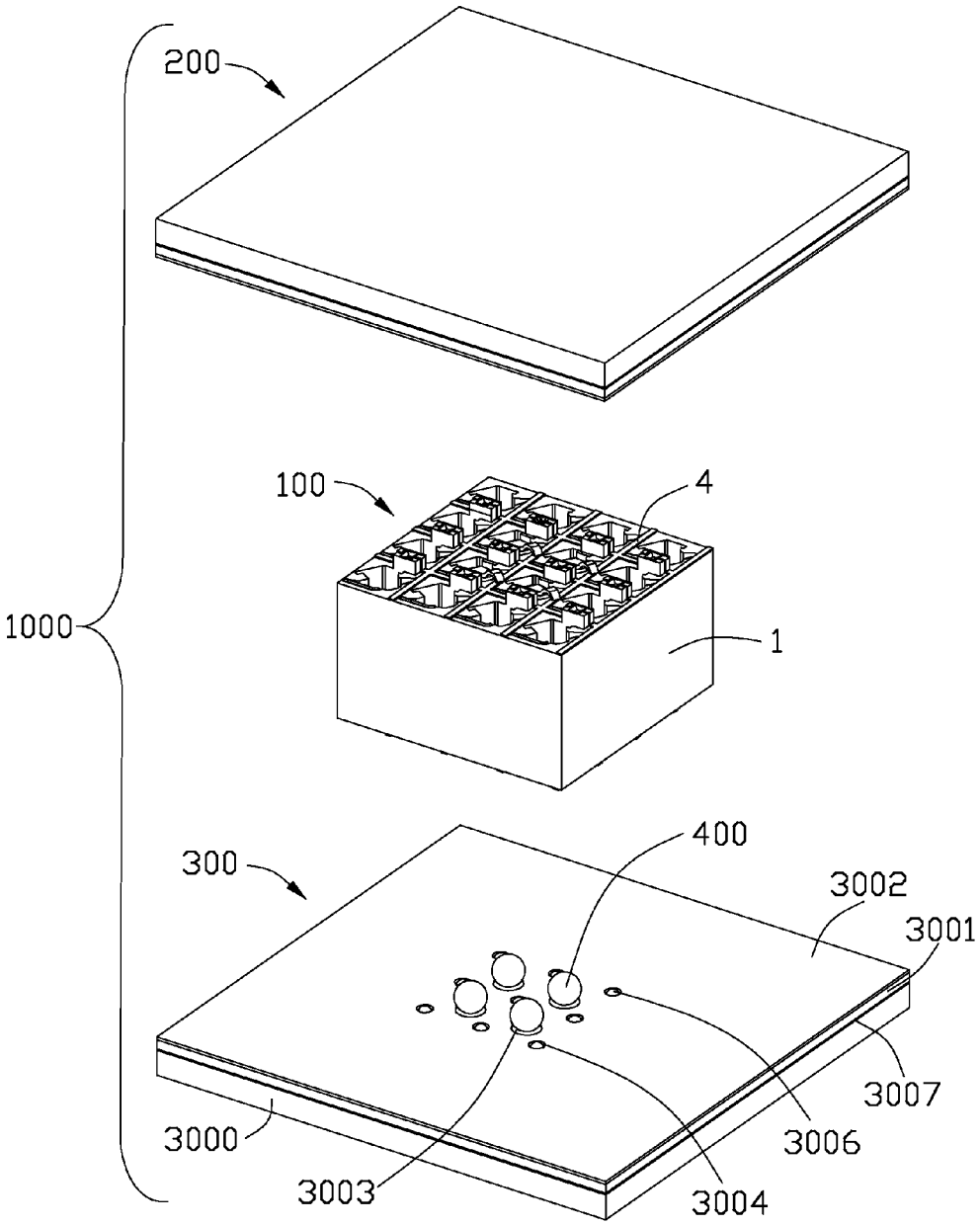
FIG. 2 is an isometric, exploded view of the electrical connector assembly shown in FIG. 1.

Referring to FIG. 2, the printed circuit board 300 locates below the electrical connector 100, and comprises an upper layer 3000, a grounding base 3007, a lower layer 3001 and a insulation layer 3002 from bottom to top direction. The top of the printed circuit board 300 (includes the lower layer 3001 and the insulation layer 3002) has a plurality of pads 3003 and a plurality of grounding elements 3006 adjacent to the pads 3003. Each of the pads 3003 is surrounded by the grounding elements 3006 and the grounding elements 3006 that are arranged in a matrix. The top of the printed circuit board 300 has a plurality of slots 3004 to receive the grounding elements 3006. The pads 3003 are tilted and the pads 3003 are electrically connecting the substrate.

Figure 5:
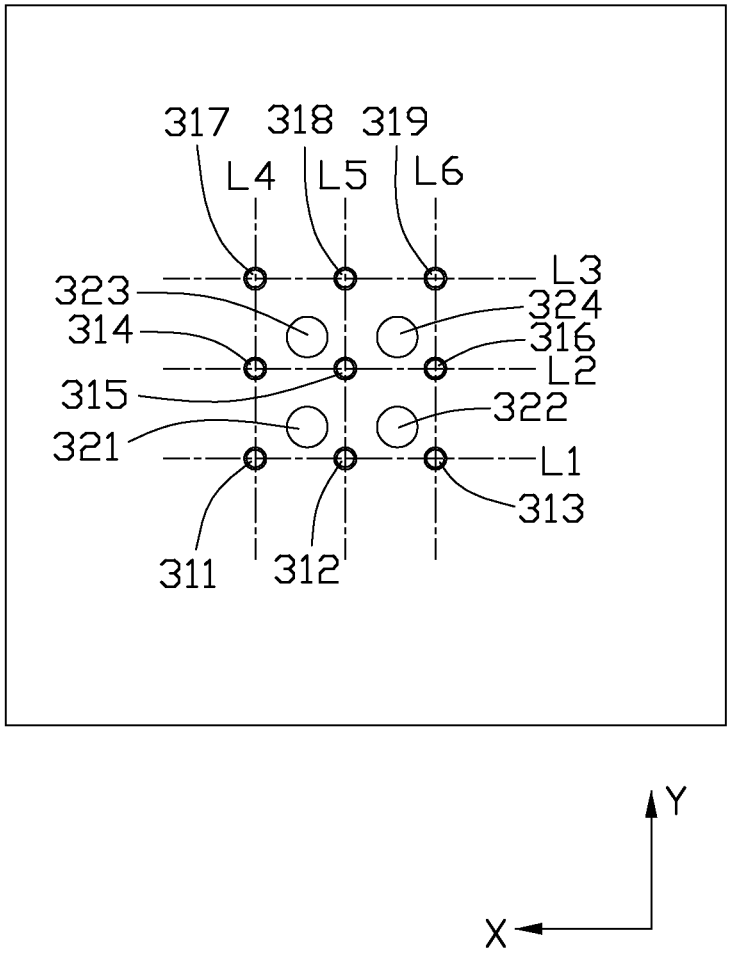
FIG. 5 is a bottom view of the printed circuit board shown in FIG. 1.

Referring to FIG. 2 and FIG. 5, the printed circuit board 300 comprise at least four pads 3003 and at least nine grounding elements 3006, the grounding elements 3006 are arranged with a matrix and each of the pads 3003 is surrounded by four grounding elements 3006. According to the preferred embodiment of the present invention, the pads 3003 comprise a first pad 321, a second pad 322, a third pad 323 and a fourth pad 324. The grounding elements 3006 comprise a first element 311, a second element 312, a third element 313, a fourth element 314, a fifth element 315, a sixth element 316, a seventh element 317, a eighth element 318 and a ninth element 319. The first pad 321 is surrounded by the first element 311, the second element 312, the fourth element 314 and the fifth element 315. The second pad 322 is surrounded by the second element 312, a third element 313, a fifth element 315 and a sixth element 316. The third pad 323 is surrounded by the fourth element 314, the fifth element 315, the seventh element 317 and the eighth element 318. The fourth pad 324 is surrounded by the fifth element 315, the sixth element 316, the eighth element 318 and the ninth element 319.

The first element 311, the second element 312 and the third element 313 are arranged in a first line L1. The fourth element 314, the fifth element 315 and the sixth element 316 are arranged in a second line L2. The seventh element 317, the eighth element 318 and the ninth element 319 are arranged in a third line L3. The first element 311, the fourth element 314 and the seventh element 317 are arranged in a fourth line L4. The second element 312, the fifth element 315 and the eighth element 318 are arranged in a fifth line L5. The third element 313, the sixth element 316 and the ninth element 319 are arranged in a sixth element L6.

Referring to FIGS. 4-5, the first line L1, the second line L2 and the third line L3 are arranged along a X direction in horizontal. The fourth line L4, the fifth line L5 and the sixth line L6 are arranged along a Y direction perpendicular to the X direction in horizontal. The first line L1, the second line L2 and the third line L3 are parallel with each other and the fourth line L4, the fifth line L5 and the sixth line L6 are parallel with each other. The first line L1 is perpendicular to the fourth line L4, the fifth line L5 and the sixth line L6 respectively; the second line L2 is perpendicular to the fourth line L4, the fifth line L5 and the sixth line L6 respectively; the third line L3 is perpendicular to the fourth line L4, the fifth line L5 and the sixth line L6 respectively.

Figure 6:
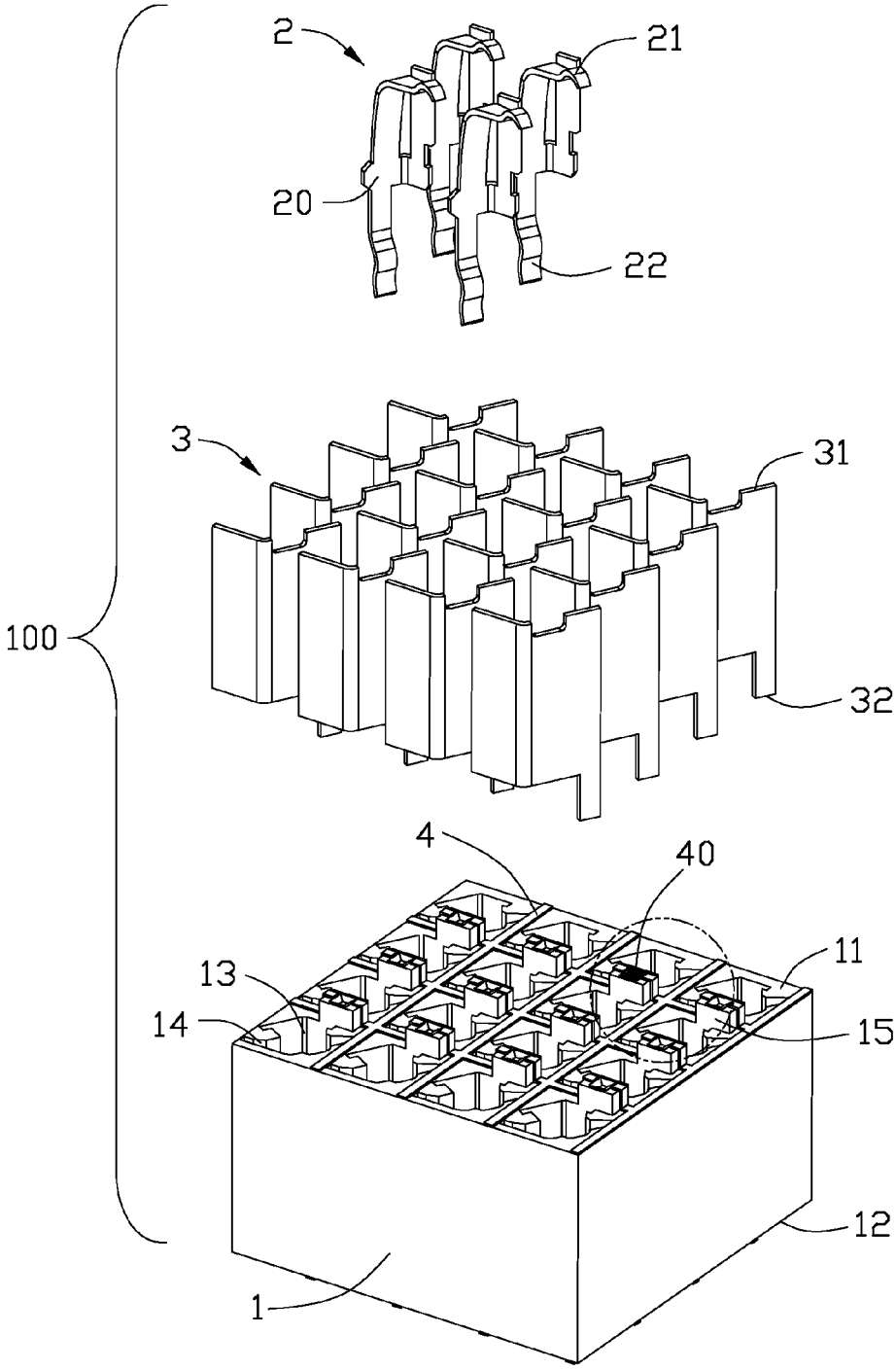
FIG. 6 is an exploded view of the electrical connector show in FIG. 1.
Figure 7:
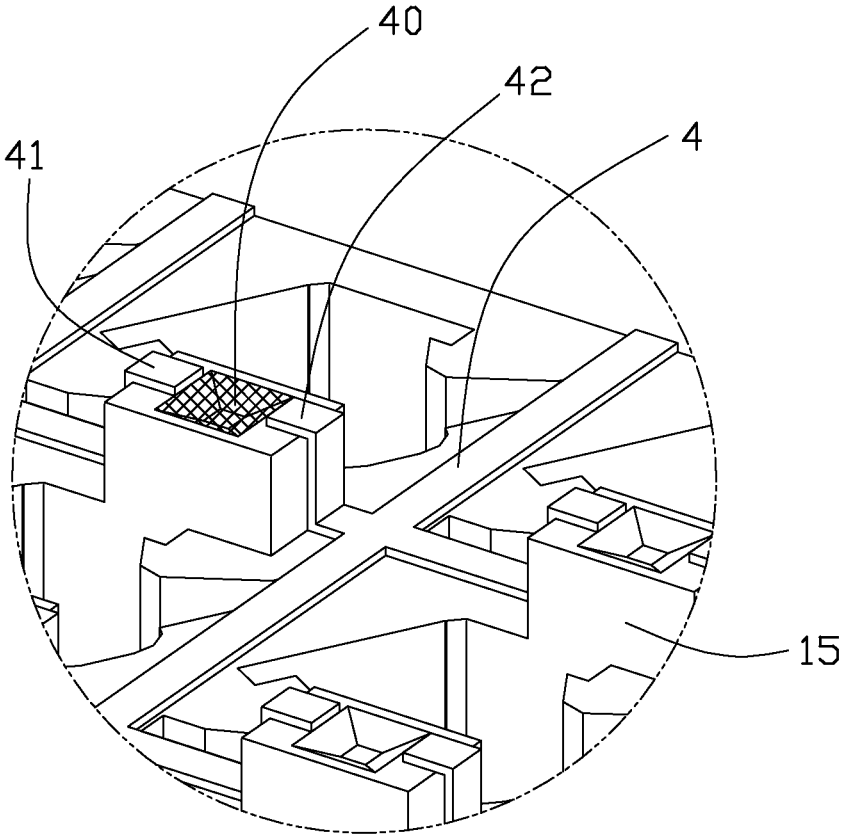
FIG. 7 is an enlarged view of the circular portion shown in FIG. 4.
Figure 8:
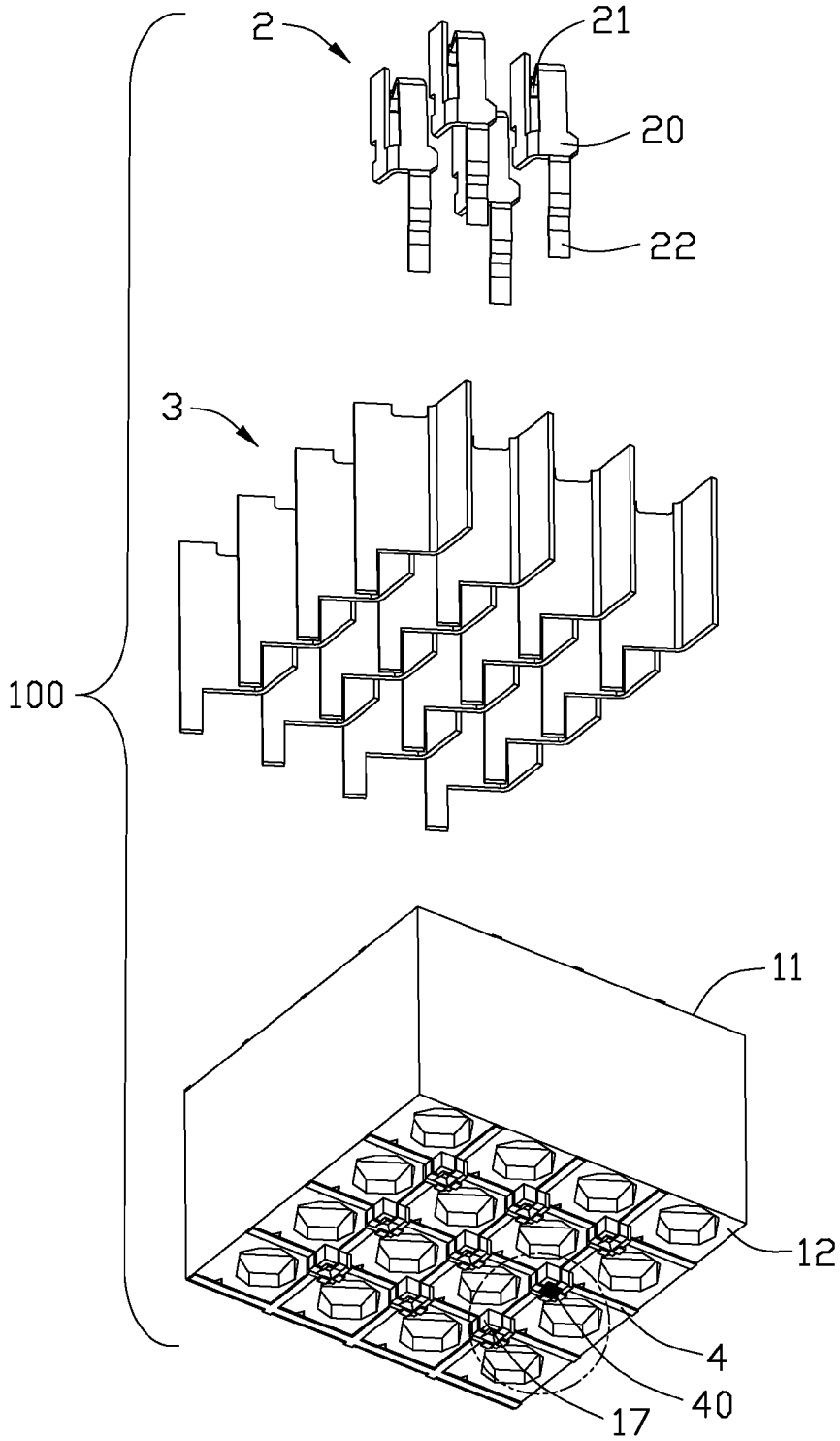
FIG. 8 is another exploded view of the electrical connector show in FIG. 1.
Figure 9:
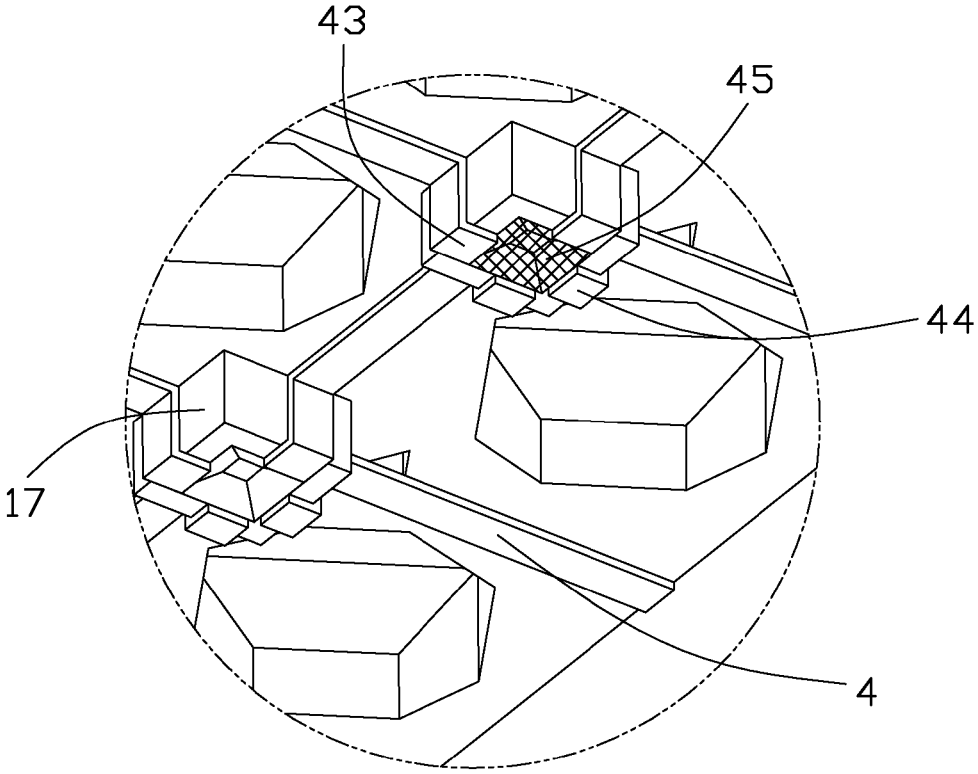
FIG. 9 is an enlarged view of the circular portion shown in FIG. 6.

Referring to FIGS. 8-9, the insulative housing 1 comprises a mating surface 11, a mounting surface 12 opposite to the mating surface 11, a plurality of receiving holes 13 penetrated from the mating surface 11 to the mounting surface 12 and a plurality of grooves connected with the receiving holes 13. The insulative housing 1 further comprises a plurality of first stand-offs 15 projecting from the mating surface 11, a plurality of second stand-offs 17 projecting from the mounting surface 12 and a grounding route 4 assembled on the mating surface 11 and the mounting surface 12 between the adjacent receiving hole 13. The grounding route 4 is located around the receiving holes 13 and is arranged in a matrix. The grounding route 4 is a metal layer electroplated to the mating surface 11 and the mounting surface 12. Referring to FIGS. 4-5, the grounding route 4 comprises a first part 41 assembled at one side of the first stand-off 15 and a second part 42 assembled at the other side of the first stand-off 15. Each of the first stand-offs 15 comprises a slot 40 located between the first part 41 and the second part 42 and an inner wall exposed in the slot 40. The metal layer on the inner wall electrically connects with the first part 41 and the second part 42. Referring to FIGS. 6-7, the grounding route 4 comprises a third part 43 assembled at one side of the second stand-off 17 and a fourth part 44 assembled at the other side of the second stand-off 17. Each of the second stand-offs 17 comprises a slot 45 located between the third part 43 and the fourth part 44 and an inner wall exposed in the slot 45. The metal layer on the inner wall electrically connects the third part 43 and the fourth part 44. Each of the terminals 2 comprises a base 20, a spring 21 extending upwardly from the base 20 and a soldering portion 22 extending downwardly from the base 20. The electrical connector 100 further comprises a plurality of grooves 14 connected the receiving holes 13, a plurality of shielding plates 3 received in the grooves 14 and a plurality of inner surfaces exposed in the grooves 14. The shielding plate 3 comprises an upper contacting portion 31 and a lower contacting portion 32 connecting the grounding route 4.

Figure 10:
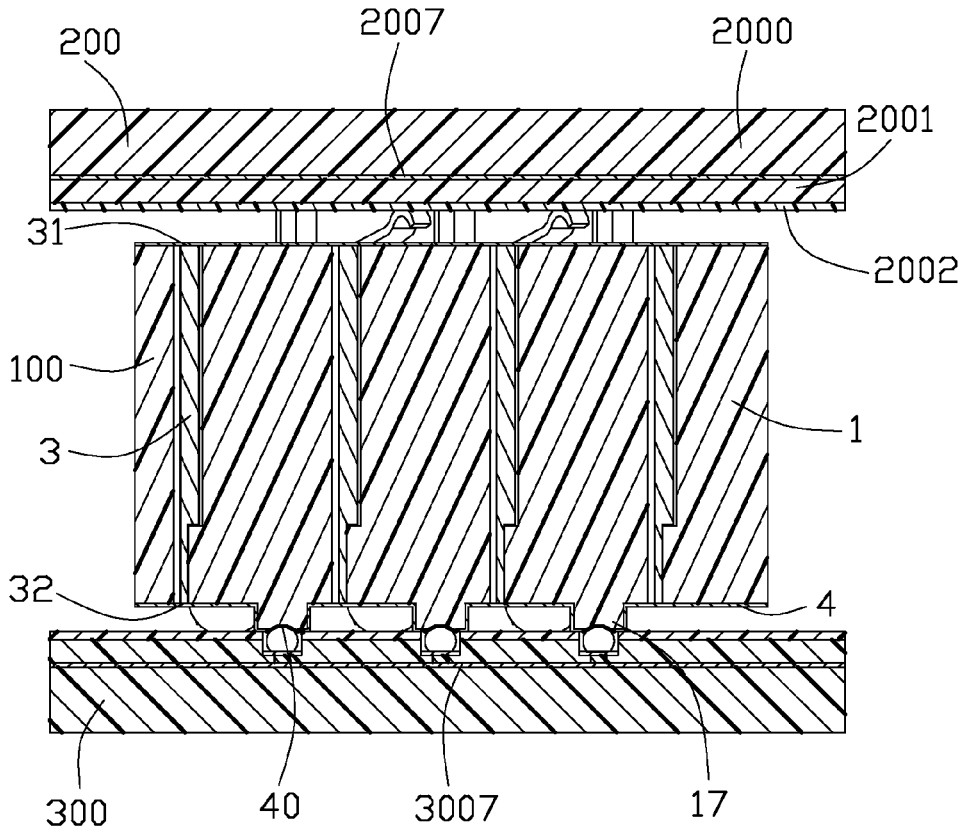
FIG. 10 is a cross-sectional view of the electrical connector assembly taken along line 10-10 in FIG. 1.
Figure 11:
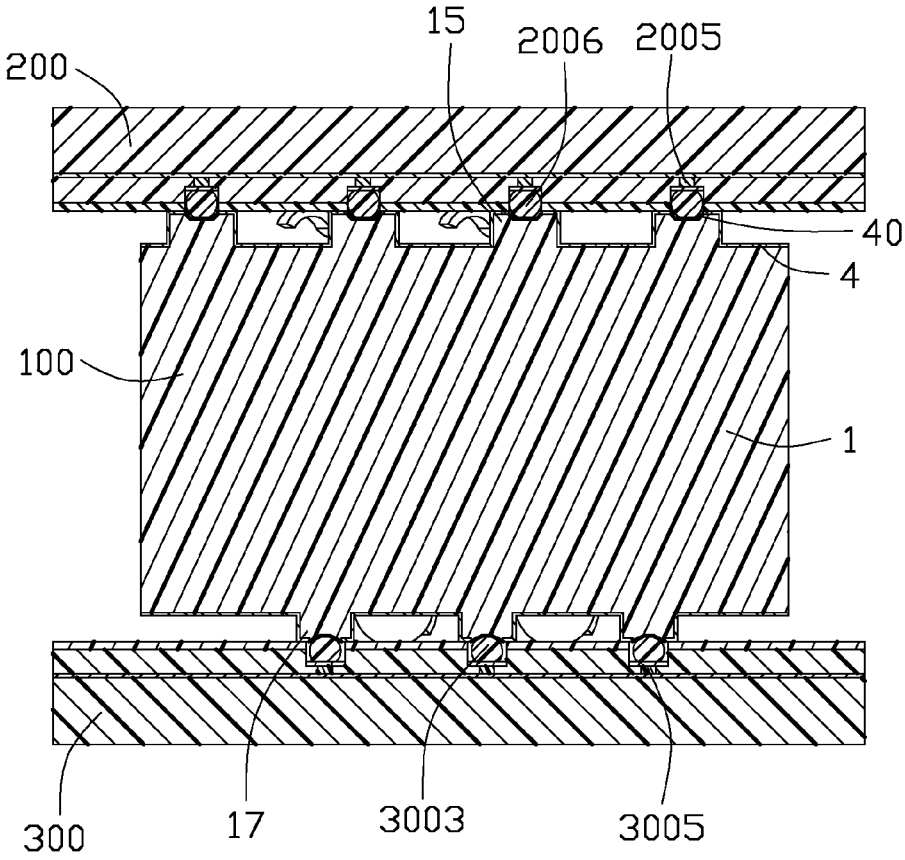
FIG. 11 is a cross-sectional view of the electrical connector assembly taken along line 11-11 in FIG. 1.

Referring to FIGS. 10-11, after the electrical connector 100 is assembled to the printed circuit board 300 and the chip module 200 is assembled to the electrical connector 100, the spring 21 contacts the pad 2003 and the soldering portion 22 is soldered to the pad 3003 by the solder ball 400, so as to electrically connect the chip module 200 to the printed circuit board 300 and transmit the signal from the chip module 200 to the printed circuit board 300. The grounding elements 2006 are attached to the slot 40 and electrically connecting with the grounding route 4. The grounding elements 3006 are attached to the slot 45 and electrically connecting with the grounding route 4.

The grounding route 4 of the electrical connector 100 electrically connecting with the shielding plates 3 and electrically connecting the shielding plates 3 as a whole. The grounding elements 2006, 3006 electrically connecting with the grounding route 4 assembled on the mating surface 11 and the mounting surface 11 and the grounding route 4 electrically connecting with the shielding plates 3, then they forms a whole shielding net and it can get a better shielding effect. The chip module 200 comprises a plurality of linking portions 2005 electrically connecting the grounding elements 2006 with the grounding base 2007, the printed circuit board 300 comprises a plurality of linking portions 3005 electrically connecting the grounding elements 3006 with the grounding base 3007, and then they provide a route for communicating the shielding current to the grounding base 2007, 3007.

The shielding plates 3 form a shielding device all around the terminals 2 in the preferred embodiment. In other embodiment, the shielding device is formed by the metal layer electroplated on the inner surfaces of the grooves 14. The pads 2003, 3003 and the grounding elements 2006, 3006 are formed by metal material including a solder ball.

Although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. An electrical connector comprising:

an insulative housing comprising a mating surface and a mounting surface opposite to the mating surface;

a plurality of receiving holes penetrated from the mating surface to the mounting surface;

a plurality of terminals received in the receiving holes; and a grounding route attached on the mating surface of the insulative housing; wherein a shielding device is exposed in the receiving holes and electrically connecting with the grounding route; said insulative housing has a plurality of first stand-offs projecting from the mating surface and the grounding route going across the first stand-offs; said grounding route comprises a first part assembled at one side of the first stand-off and a second part assembled at the other side of the first stand-off, wherein said first stand-off comprises a slot located between the first part and the second part and an inner wall exposed in the slot, the inner wall has a metal layer electrically connecting with the first part and the second part.

2. The electrical connector as claimed in claim 1, wherein said grounding route is assembled between the receiving holes and locates around the receiving holes in matrix.

3. The electrical connector as claimed in claim 1, wherein said electrical connector further comprises a plurality of grooves connected with the receiving holes and a plurality of shielding plates received in the grooves, the shielding plates form the shielding device.

4. The electrical connector as claimed in claim 1, wherein said electrical connector further comprises a plurality of grooves connected with the receiving holes and a plurality of inner surfaces exposed in the grooves, the inner surface has the metal layer electrically connecting with the grounding route.

5. The electrical connector as claimed in claim 1, wherein said mounting surface is also attached on said grounding route, the grounding route is plated to the mating surface and the mounting surface, the shielding device contacts the grounding route.

6. The electrical connector as claimed in claim 5, wherein said insulative housing has a plurality of second stand-offs projecting from the mounting surface and the grounding route going across the second stand-offs.

7. The electrical connector as claimed in claim 6, wherein said grounding route comprises a third part assembled at one side of the second stand-off and a fourth part assembled at the other side of the second stand-off, wherein said second stand-off comprises a slot located between the third part and the fourth part and an inner wall exposed in the slot, the inner wall has the metal layer electrically connecting the third part and the fourth part.

8. An electrical connector assembly electrically connecting a chip module to a printed circuit board, and comprising:

an electrical connector comprising an insulative housing with a plurality of receiving holes and a plurality of terminals received in the receiving holes, the insulative housing having a mating surface and a mounting surface opposite to the mating surface;

an electrical component assembled to the electrical connector, and comprising a substrate, a plurality of pads assembled on the substrate and a plurality of grounding elements assembled on the substrate, the grounding element located close to the pad and located around the pad in matrix; and wherein the electrical connector also comprises a grounding route assembled on the mating surface, a shielding device exposed in the receiving holes and electrically connecting with the grounding route, the grounding elements electrically connect with the grounding route.

9. The electrical connector assembly as claimed in claim 8, wherein the grounding elements are solder balls.

10. The electrical connector assembly as claimed in claim 8, wherein the grounding route is assembled on the mounting surface.

11. The electrical connector assembly as claimed in claim 8, wherein said electrical connector further comprises a plurality of grooves connected with the receiving holes and a plurality of shielding plates received in the grooves, the shielding plates form the shielding device.

12. The electrical connector assembly as claimed in claim 8, wherein said insulative housing has a plurality of first stand-offs projecting from the mating surface, the grounding route comprises a first part assembled at one side of the first stand-off and a second part assembled at the other side of the first stand-off, wherein said first stand-off comprises a slot located between the first part and the second part and an inner wall exposed in the slot, the inner wall has the metal layer electrically connecting the first part and the second part.

13. The electrical connector assembly as claimed in claim 8, wherein said grounding elements corresponding to the first stand-offs electrically connect to the metal layer of the slot.

14. The electrical connector assembly as claimed in claim 8, wherein said insulative housing has a plurality of second stand-offs projecting from the mounting surface, the grounding route comprises a third part assembled at one side of the second stand-off and a fourth part assembled at the other side of the second stand-off, wherein said second stand-off comprises a slot located between the third part and the fourth part and an inner wall exposed in the slot, the inner wall has the metal layer electrically connecting the third part and the fourth part.

15. The electrical connector assembly as claimed in claim 14, wherein said grounding elements corresponding to the second stand-offs electrically connect to the metal layer of the slot.

16. An electrical connector assembly comprising:

an insulative housing defining a plurality of passageways extending therethrough in a vertical direction between two opposite exterior surfaces, each of said passageways essentially defining a plurality of sides in a cross-section;

a plurality of terminals disposed in the corresponding passageways, respectively, each of said terminals occupying at least one side of said plurality of sides and having upper contacting section around one of the two opposite exterior surfaces for mating with an electronic package and a lower connecting section around the other of said two opposite exterior surfaces for mounting to a printed circuit board;

a plurality of shielding devices disposed in the corresponding passageways, respectively, each of said shielding devices occupying at least another side of said plurality of sides; and a net type grounding route formed upon at least one of said two opposite exterior surfaces along partitions among said passageways; wherein said grounding devices are electrically and mechanically connected to said grounding route to complete a three dimensional grounding/shielding effect.

17. The electrical connector assembly as claimed in claim 16, wherein said plurality of sides are four sides, and each of said terminals occupies two of said four sides while the corresponding shielding device occupies another two of said four sides.

18. The electrical connector assembly as claimed in claim 16, wherein on said at least one of said two opposite exterior surfaces, a plurality of solder ball receiving recesses are formed in corresponding intersections of said partitions for receiving corresponding solder balls of the electronic package or of the printed circuit board.

* * * * *